US006902500B2

(12) United States Patent
Pettey

(10) Patent No.: US 6,902,500 B2
(45) Date of Patent: Jun. 7, 2005

(54) SPORT GAME

(76) Inventor: Philip E. Pettey, 21 Richard Ave., North Merrick, NY (US) 11566

( * ) Notice: Subject to any disclaimer, the term of this patent is extended or adjusted under 35 U.S.C. 154(b) by 0 days.

(21) Appl. No.: 10/133,944

(22) Filed: Apr. 26, 2002

(65) Prior Publication Data

US 2003/0203774 A1 Oct. 30, 2003

(51) Int. Cl.[7] ..... A63B 67/00
(52) U.S. Cl. ..... 473/470
(58) Field of Search ..... 473/470, 471–473, 473/474, 478, 479, 456, 466, 459, 490

(56) References Cited

U.S. PATENT DOCUMENTS 2,196,861 A * 4/1940 Gruber ..... 273/282.1
3,746,340 A * 7/1973 Ellis ..... 473/471
4,284,277 A * 8/1981 Leonard et al. ..... 473/471
4,482,157 A * 11/1984 McNeil ..... 473/470
4,546,973 A * 10/1985 Mouser ..... 473/472
4,911,443 A 3/1990 Foster
6,045,466 A 4/2000 Suess

OTHER PUBLICATIONS

HouseRules WebPage, Rules of the Game, Oct. 9, 1986, www.njvb.com/clubs/hovb/rules.htlm, 3 pages.*
Mansfield WebPage, Mansfield Middle School, Feb. 21, 2001, www.ecus.ctstateu.edu/depts/edu/units/mansfieldpe/basketball.htlm, 6 pages.*

* cited by examiner

*Primary Examiner*—Gregory Vidovich
*Assistant Examiner*—M. Chambers
(74) *Attorney, Agent, or Firm*—Keusey, Tutunjian & Bitetto, P.C.

(57) ABSTRACT

A game and method of playing a game are disclosed. A playing field having a scoring objective region and a neutral zone extending from the scoring objective region are provided. The neutral zone divides the playing field. At least two playing objects are activated to initiate a play wherein the activating designates play zones relative to the neutral zone where players remain for a remainder of a play. The playing objects are conveyed to the players on the field to permit scoring opportunities for the players.

40 Claims, 6 Drawing Sheets

SPORT GAME

BACKGROUND

1. Technical Field

This disclosure relates to a sport game, and more particularly, to a game played using two or more playing objects simultaneously to provide a game with no inactive positions.

2. Description of the Related Art

Contact sports, such as football or hockey, tend to be exciting to watch but dangerous to play. As a result, players have high occurrences of injuries and in many cases shortened careers. One of the advantages of contact sports such as football and hockey is that the game has a preset game time. Furthermore these games are broken down into quarters or periods, which provide times for rest and/or rethinking the game strategy. Time outs and breaks within the game are particularly desirable by sports broadcasters since commercials or other announcements/news can be relayed to the viewing audience.

Many sports have limited seasons for play. For example, football is played in the cooler months due to the amount of protection equipment and padding needed while baseball is played in the warmer months since an outdoor filed is needed and padding or other equipment is not needed. It would be advantageous to provide a sport game that can be played all year round indoors or outdoors.

Although overall play of sports may be exciting, many of the players have "dead" or inactive positions, which are less exciting. Focusing on football, lineman or blockers may be less desirable positions from the standpoint of players since there positions seldom have access to the ball and are typically gain less recognition than receivers or the quarterback.

Therefore, a need exists for a sport game, which eliminates "dead" positions, may include a preset time for play and reduces or eliminates player contact. A further need exits for a fast-paced game that can be played indoors or outdoors and during any season.

SUMMARY OF THE INVENTION

A method of playing a game includes a playing field having a scoring objective region and a neutral zone extending from or through the scoring objective region are provided. The neutral zone divides the playing field. At least two playing objects are activated to initiate a play wherein the activating designates play zones relative to the neutral zone where players remain for a remainder of a play. The playing objects are conveyed to the players on the field to permit scoring opportunities for the players. A program storage device readable by machine, tangibly embodying a program of instructions executable by the machine by be included to perform the method steps for playing the game of the present invention.

A game of the present invention includes a play region including a scoring objective region and a neutral zone. The neutral zone extends from or through the scoring objective region, and divides the playing field to form two or more play zones each having a portion adjacent to the scoring objective region. An offensive start position is disposed opposite from the scoring objective region in the play region, and defensive positions are disposed between the offensive start position and the scoring objective region. Players convey at least two playing objects during play in designated play zones to provide scoring opportunities for the players.

Another game in accordance with the present invention includes at least two play regions each including a scoring objective region and separated by a neutral zone. At least two playing objects are simultaneously conveyed by players in the at least two play regions to provide scoring opportunities for the players wherein an overall outcome of a play is related to an outcome in each of the play regions during that play.

These and other objects, features and advantages of the present invention will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF PREFERRED EMBODIMENTS

The present invention provides a new sport game that may be played indoors or outdoors. The sport game includes the use of at least two playing objects to be passed down field, down rink or down court. These live objects may include balls or pucks, for example. In one embodiment, footballs are employed. A playing field includes a scoring zone on one end and a start zone on a second end opposite the scoring zone. Play begins with a start event where the objects become live. The objects must than be successfully conveyed down field to receivers. If two completions are successful, the start zone is moved toward the scoring zone according to a set of rules. For example, the new start zone could be at the point of the farthest completion of the two objects. While the receivers are down field, defenders protect the field from the advance of the offensive receivers. Defenders are to prevent the completions, and in one embodiment are capable of scoring points even without possession of the live object(s). For example, if defenders prevent one or more completions, points may be scored for preventing the completions, such as e.g., one point per prevented completion.

The present invention will now be described in terms of a sport game, which employs footballs as the live objects. However, the present invention is broader and should not be construed as limited to the illustrative example. The present invention may be employed other configurations and features. For example, the present invention may be implemented using a hockey puck and sticks, a la cross ball and sticks, field hockey balls and sticks, soccer balls, basketballs, baseballs and bats or any other suitable apparatus. The present invention may be played as an athletic sport, as a board game or as a video game.

Figure 1:
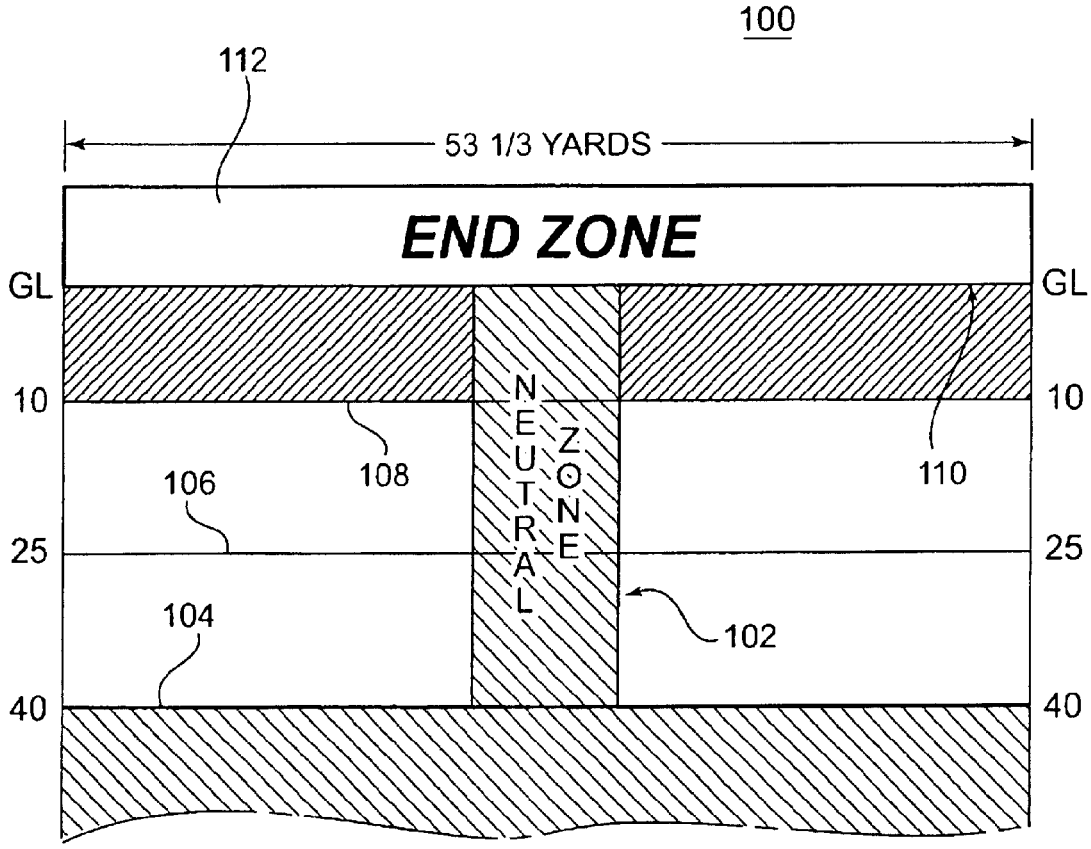
FIG. 1 is a layout view of a play region in accordance with one embodiment of the present invention.

Referring now in specific detail to the drawings in which like reference numerals identify similar or identical elements throughout the several views, and initially to FIG. 1, a field layout or play region 100 is shown for an illustrative embodiment of the present invention. Field 100 may include a football field or other outdoor field or may include an indoor court or rink depending on the type of playing apparatus is employed. In this illustrative example, a football field is employed for field 100. Field 100 may include a standard football field width, say, e.g., 53 and ⅓ yards or any other width. Field 100 may employ a 40 yard length playing field. Advantageously, two or more games may be played simultaneously on a same football field.

Field 100 includes a neutral zone 102, which runs parallel to the length of the field. Neutral zone 102 may include a thickness of nearly zero or may be as large as 10 to 20 yards. Other dimension for the neutral zone may be employed as well. If a football field is employed, field 100 may include hash marks indicating yards. Field 100 includes a start line 104 which maybe located at the 40 yard mark. Other lines may also be designated on field 100. For example, lines 106 and 108 may indicate a location on field 100 which if achieved resets the number of chances an offensive team gets to attempt to advance the start line further. A goal line 110 indicates a position, if achieved scores points for the offensive team. Advancement to or beyond goal line 110 and within an end zone 112 results in an offensive score.

Features of the present invention will now be illustratively described in greater detail. It should be understood that the rules of play may be adjusted and modified in accordance with the scope and spirit of the present invention. In one embodiment, a game in accordance with the present invention has some similarities to football. An overall similarity of the present game to football is the high level of intensity and competitiveness of the passing game. It has the offensive similarities of a quarterback attempting to move a team down the field to score through only passing the ball. The defensive similarities are a defensive team attempting to stop an offensive team's quarterback and receivers from obtaining their goal of scoring a touchdown by providing defensive coverage.

Advantageously, the present game reduces contact between players of opposing teams. Since contact has been greatly minimized, greater overall participation is provided with far fewer injuries. Retired players or players of any stature can participate since blocking positions and tackling are eliminated in the present invention. Punting or kicking may or may not be included in the present game. Also, running with the football to gain yardage or running after the catch with the football to gain yardage is not needed as the ball is preferably dead at the point of the catch or at the point of the interception. These rules and features of football may or may not be included in an individual game; however different variations of the game of the present invention are contemplated and may include such features and rules.

Figure 2:
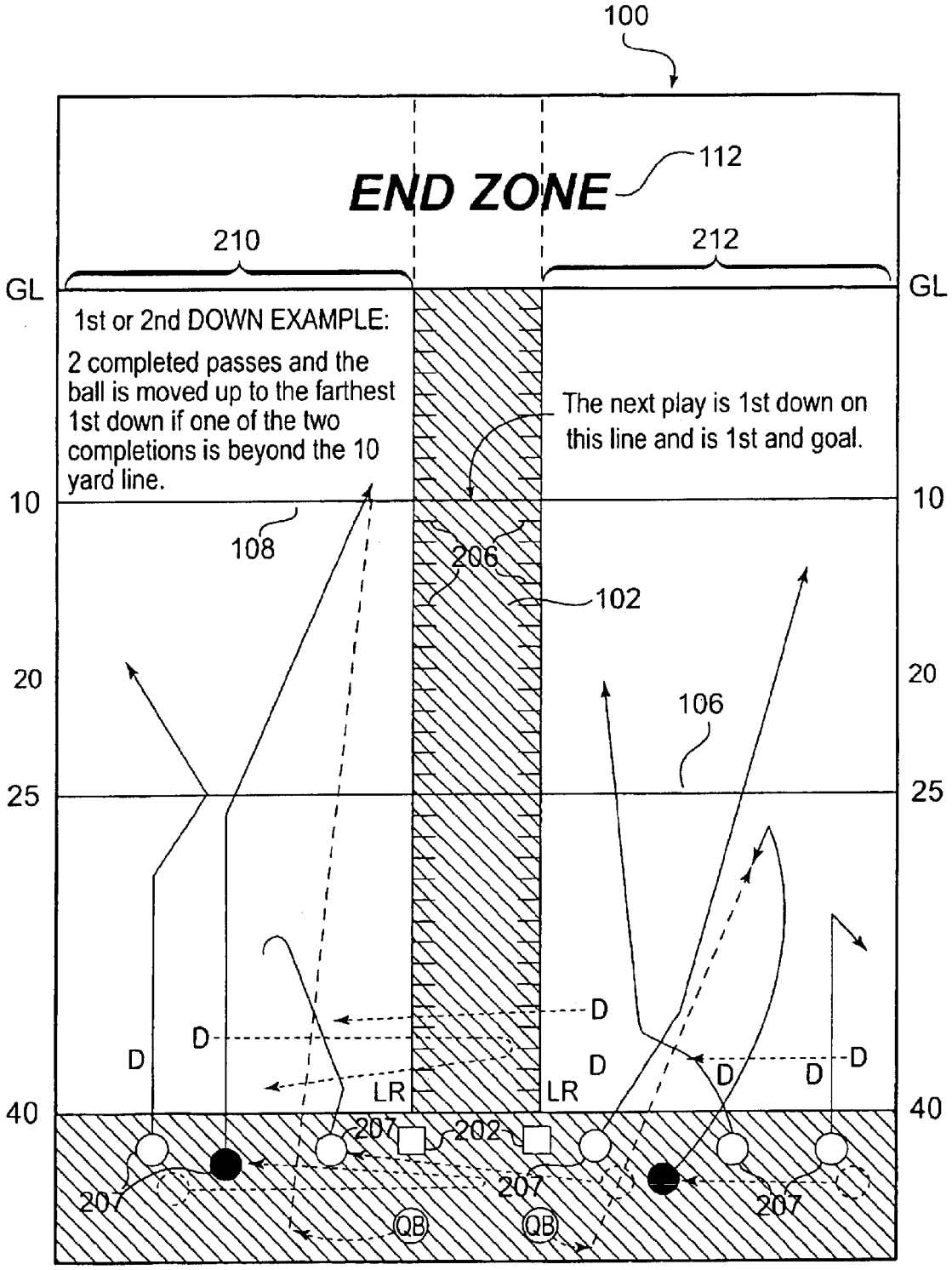
FIG. 2 is a schematic diagram showing an example of a play being executed from an initial start position in accordance with the present invention.

Referring to FIG. 2, an offensive team has players designated by O's or circles and boxes 202 and two quarterbacks QB (using two or more balls instead of one) simultaneously attempting to move their offensive team completing passes.

In the embodiment shown in FIG. 2, the field 100 is 40 yards long to the end zone goal line with 2 first downs at 15 yards each and 10 yards to the end zone goal line. The first down distances may be adjusted as needed or desired. The end zone 112 may be 10 yards deep like a regular football field. The area between field hash marks 206 is a dead or neutral zone 102.

Advantageously, on a regulation size football field two games could be going on at the same time driving the ball in opposite direction from mid-field (50 yard-line). The offensive team may include eleven players on the field at one time. This may be changed as needed or desired. Two of the players on the offensive team are passers or quarterbacks (QB), two (202) are rotating snappers, and seven (207) are receivers. Defensive team indicated by D's and LR's include two rotating line runners (LR), and seven man-to-man pass defenders (D). To keep players fresh, players may be substituted on any change of possessions, but preferably not during a drive.

In the example, the offense preferably has 4 downs to complete 2 passes simultaneously to make a $1^{st}$ down. In one embodiment, the ball is marked on the farthest of the two passes and when the farthest pass is beyond a $1^{st}$ down line, e.g., 25 yard line or 10 yard line, a first down has been achieved. Other methods may be employed for marking the ball, for example, the closest ball or the average between the completed passes may be employed, or a single completion may be used to mark the ball. For passes to count the pass is to be completed beyond the line of scrimmage or start point. In alternate embodiments, a completed pass may be run as well to attempt a score. A run may be prevented by, for example, tagging the ball carrier, removing a flag from the ball carrier or by tackling the ball carrier.

Other methods may be employed for achieving a first down (4 more chances for the offense to score). for example, on any $3^{rd}$ and $4^{th}$ down, any 2 completions simultaneously; even if not long enough for a $1^{st}$ down may still be called a first down and the ball may or may not be moved up to the closest $1^{st}$ down line. However, this rule would not apply within the 10 yard line to the end zone. In that zone the offense must score and first downs (additional chances) are not permitted.

In this embodiment, there is no running after a catch; instead, the ball is marked at the deeper position of the two catches. The defense can play man-to-man coverage or zone coverage. Before a first signal, players on the offense and defense may cross between zones 210 and 212. At a first signal, any players in zone 210 must remain in zone 210 during that play and any players in zone 212 must remain in zone 212 during that play. Any players trapped in the neutral zone 102 are eliminated from play for that play. Neutral zone 102 may extend to the end zone or continue through the end zone. Depending on how the particular game is played, play zones 210 and 212 and neutral zone 102 may extend into the end zone 112.

At the first signal, the balls are snapped to the QB's. The QB's have a preset time say 5–10 seconds to pass the ball. If two completions are made the ball is marked designating a new start line or line of scrimmage. When the play is over, the players may be required to get back to the line of scrimmage in a given amount of time (for example, 10 seconds) to allow pre-snap motions.

After a score or a turnover (interceptions/downs), the defensive team is given the ball on the 40 yard line and the offensive team goes on defense. Substitutions of players may be made at this time. Turnovers may be made if one or both balls are intercepted by the defensive team. Although not likely, fumbles may also result in a turnover.

Players may be rotated between positions, for example, whoever was passed the ball complete or incomplete on the last down must retrieve the ball, run it back to the line of scrimmage and act as the snapper to a QB for the next play. Snappers 202 may be receivers or may be left out of the play on which they snapped the ball. Likewise, LR's may be determined by the snappers for the previous play. For example, whoever covered the snapper in the previous play is the LR in the present play. The LR can only run the line of scrimmage and knock down the QB's pass. A knocked down pass or the QB not getting the ball out on time (e.g., in 4 seconds) penalty may result in the same snapper being used again for the next play. Other rotations and designations for positions may also be employed.

Many scoring arrangement may be devised in accordance with the present invention. For example, scoring may be awarded as follows:

1) Any offensive touchdown (ball in zone 112) may be worth 7 points;

2) Any offensive touchdown in the last 2 minutes of a game may be worth more, e.g., 10 points;

3) Any defensive interception may be worth 3 points and possession of the ball(s) (turnover); and 4) Any 2 picks (interceptions) on the same play may be worth 6 points and a turnover.

Other scoring opportunities may be employed in accordance with the present invention. It is noted that the defensive team is preferably capable of scoring without having possession of the ball(s). For example, prevented completion may each be awarded one or more points to the defensive team. The offense may also have an end zone where the defense can run back an intercepted pass to score.

Advantageously, games are fast paced and can be any length of time, but are preferable 15 minutes long, with a running clock. In one embodiment, the offensive team has 10 seconds to reset and snap the playing ball. Change of possessions may be 20 seconds long. Other times may be employed as well.

The following optional rules maybe employed to help keep the game intense and fast paced.

1) An offensive offsides or an offensive player does not get back to the line of scrimmage in time results in a delay of game and a loss of down.

2) The last intended receiver catch or no catch becomes the snapper, i.e., he/she must chase the ball down and is responsible for getting it back to the line of scrimmage for the next down.

3) If the defense obstructs the offense from getting the ball back to the line of scrimmage it becomes an automatic $1^{st}$ down. (any obstruction by the defense inside the 10 yard line may become a touchdown for the offense, a score deduction for the defense or a penalty, which may be assessed in yards or playtime.)

4) If the line runner (the last pass defender) is not on the line of scrimmage at the snap of the ball, it is an automatic $1^{st}$ down. (inside the 10 yard line it becomes a touchdown for the offensive team, a score deduction for the defense or a penalty, which may be assessed in yards or play time.)

5) If the game is tied at the end of regulation time (e.g., fifteen minutes), the following may be employed to determine the winner. First, the team with the most interceptions will be awarded one point and the win. Second, if both teams have the same number of interceptions then, the team that scored last will be awarded one point and the win.

Other rules and play features may also be included. For example extra points may be awarded if two completions are made in the end zone in the same play. An extra point by kicking a field goal or a two point conversion may be employed. It is to be understood that penalties may be assessed against a violating team by taking back yardage, adding or subtracting time from play or adding or deducting points and/or adding or subtracting players. Yardage penalties maybe assessed in a similar fashion as traditional football. As a penalty, time may be subtracted or added to a team at numerous time periods. For example, the time period before snapping, the time allotted for passing or the game time may all be augmented in accordance with the present invention. Point addition or deduction rules may also be determined and employed in accordance with the present invention.

Another feature of the present invention includes that each of the QB's on offense have to complete passes to the receivers in the same zone (210 or 212) on the same side as the respective QB. Whatever receivers are on the same side of the neutral zone 102 as the respective QB are eligible receivers for the QB on that side of the neutral zone. The neutral zone 102 is a dead zone (similar to being out of bounds). In one embodiment, the QB has to complete his/her pass to the opposite side of the neutral zone 102 or alternately under certain conditions both passes are to be completed on the same side of the neutral zone even though QB's are separated by the neutral zone. If a ball is thrown to or caught by a receiver, that receiver is responsible to run it back to the line of scrimmage (start line). He must snap it to the QB at a 5 yard distance, within the 10 second timer. 10 second violations will constitute a delay of game and a loss of down.

Each QB could have a different number of receivers at the time of the snap. Players other than the snappers and QB's can be in motion before the snap, and all defensive players except LR's can also be in motion before the snap. Once the balls are snapped, the receivers and defensive players are locked on their respective sides (either zone 210 or 212) on their side of the neutral zone 102. All lateral or vertical motion is legal as long as the line of scrimmage is not crossed before the snap. Whatever side of the neutral zone 102, a receiver ends up on, is the side they remain on for that play, and if a player is caught between in the neutral zone 102 before the snap that player is dead (out) for that play.

One objective is to complete two passes at the same time. The completion of one short and one long pass is acceptable, because the ball may be marked on the longer of the two catches.

Some penalties that maybe attributed to the offense include the following. If any receiver is offsides on a snap or not returned from the previous play a delay of game and a loss of down penalty is in charged to the offense. Moving picks or run through defender picks may cost that team one wide receiver for the rest of the drive and a loss of down. (e.g., that team plays short-handed for the rest of that drive and the defensive team will have an extra man to cover someone or play deep safety). If the offense looses a man because of a penalty, the defense has one extra defender. That extra defender can play zone or double coverage any man he wants for the rest of that drive. Otherwise zones are not allowed. If the offensive team is winning with less than five minutes to play in the game, and they are assessed two delay of game penalties in the same series, this may result in a turnover and the defensive team is awarded the football for a new series. Other rules and modifications to these rules are also contemplated.

Since all excessive contact is not allowed and will be penalized, the sport game of the present invention is particularly suitable for play both professionally and in a school or club environment. Defensive players can knock down the pass or intercept the ball, but physical contact is limited.

Some penalties that maybe attributed to the defense include the following. If the line runner leaves the line of scrimmage on either side or is not back on the line of scrimmage on the snap of the football it may be an automatic $1^{st}$ down for the offense (and inside the 10 yard line this equals a touchdown). If the defender plays through the receiver, to make a defensive play or is called for holding, he maybe penalized for the rest of the drive by being removed from play and leave his team short handed. The defense will not have a line runner for the rest of the drive. This may also result in an automatic $1^{st}$ down. (and inside the 10 yard line equals a touchdown).

Figure 3:
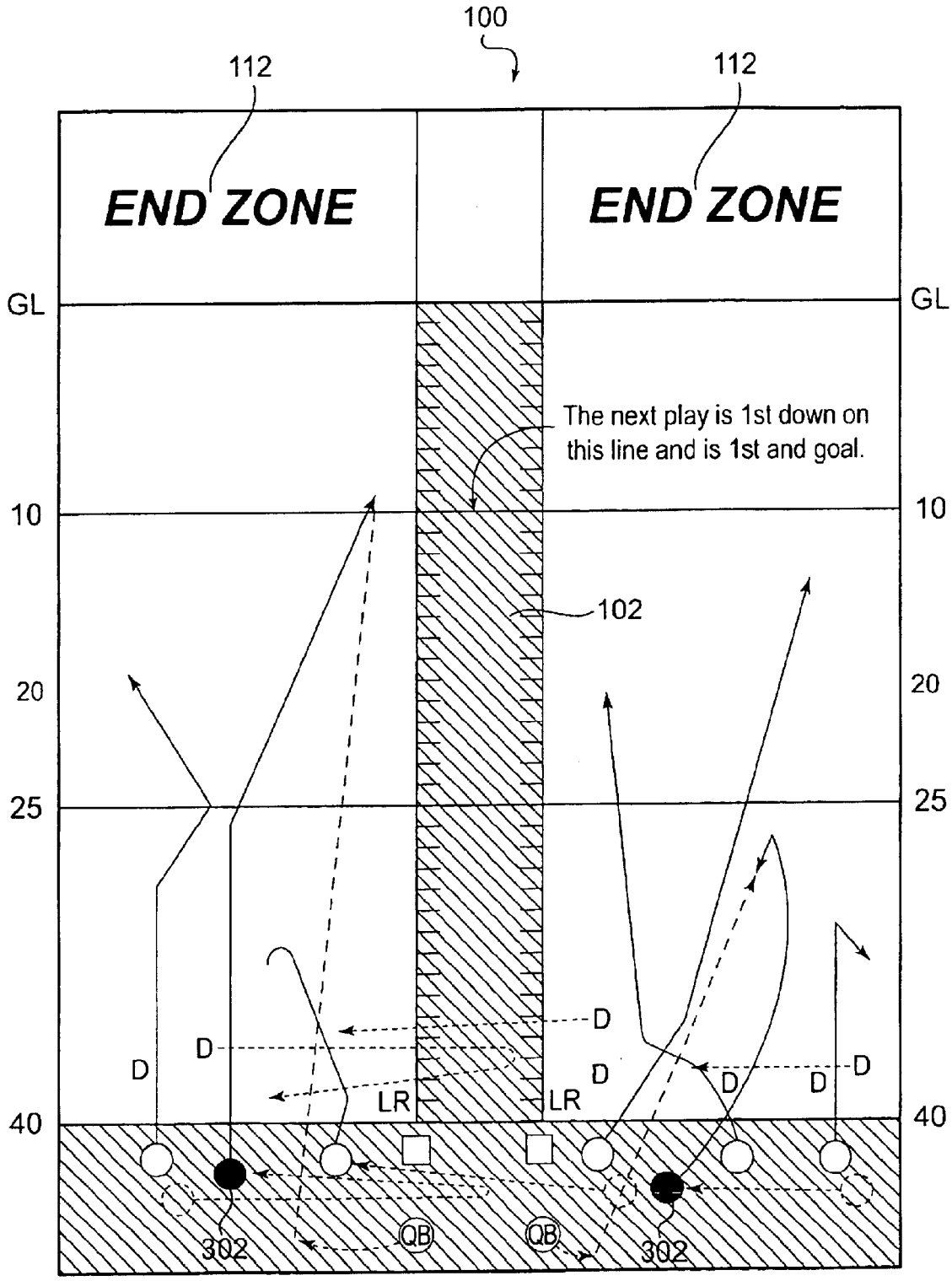
FIG. 3 is a schematic diagram showing a different example of a play being executed from a new start position in accordance with the present invention.
Figure 4:
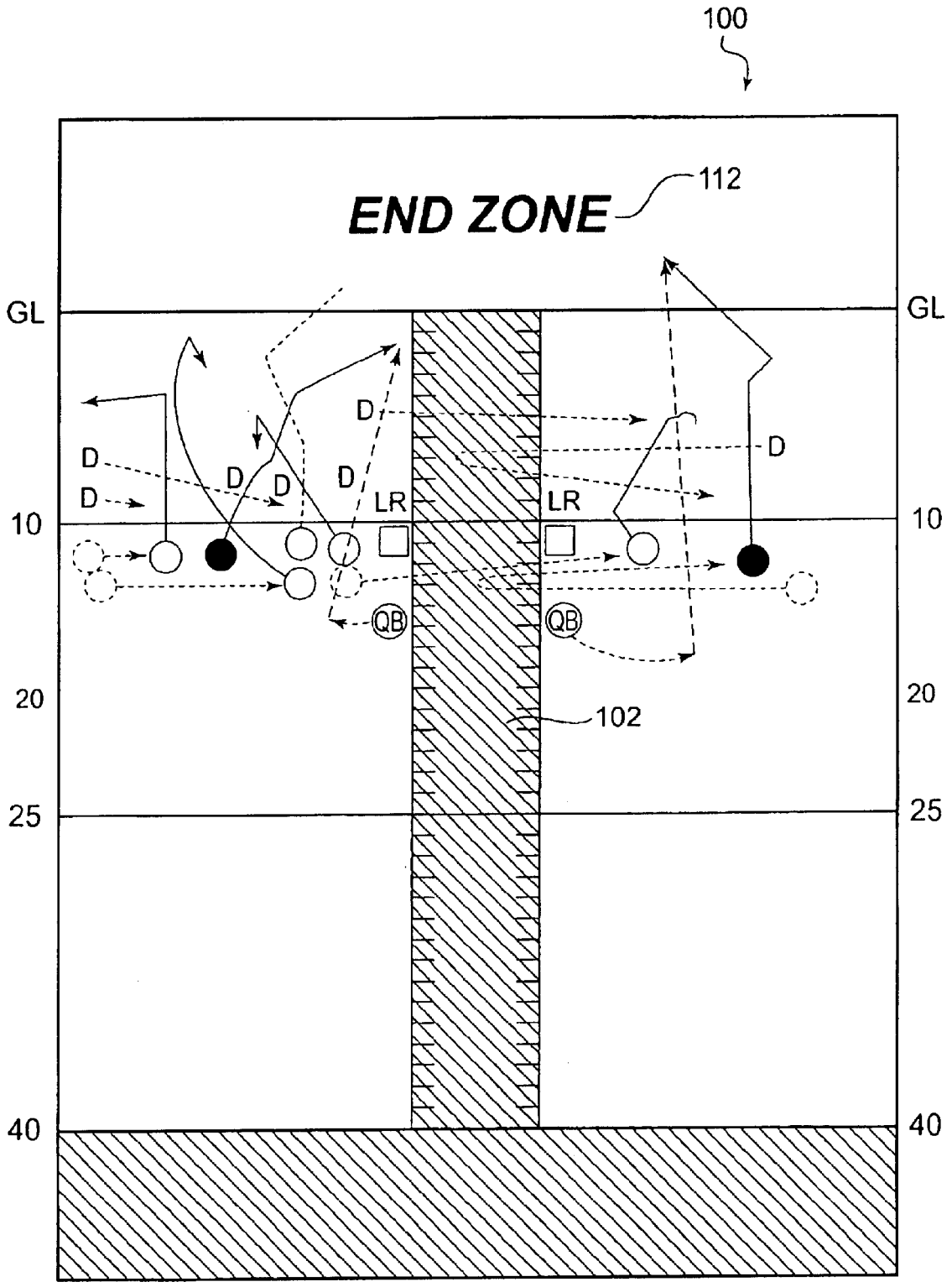
FIG. 4 is a schematic diagram showing an example of a play, which results in an offensive team score in accordance with the present invention.

Referring to FIGS. 3 and 4, two illustrations of game play are shown to further exemplify the present invention. FIG. 3 shows completed passes made to receivers 302 (black dots). The start position for the next play would be beyond the 10 yard line since this was the location of the farthest completion. Since the farthest completion was beyond a first down marker (10 yard line), the offense gets a first down (e.g., 4 more chances to score or move the line of scrimmage closer to the goal line). Note the motion of the players relative to the neutral zone 102 on both offense (O) and defense (D), prior to the snap, as depicted by short dotted lines. The pass trajectory is depicted by long dotted lines, and the routes run by the eligible receivers is depicted by solid lines.

FIG. 4 shows an example of an offensive score. Again, note the motion of the players relative to the neutral zone 102 on both offense (O) and defense (D), prior to the snap, as depicted by short dotted lines. The pass trajectory is depicted by long dotted lines, and the routes run by the eligible receivers is depicted by solid lines. Since the farthest completion is in the end zone the offense scores.

The present invention has been shown in terms of a game similar to American football. However, the concepts of the present invention may be extended to other sports or games. For example, the present invention may be employed using hockey sticks and pucks. Instead of a snapper, players drop pucks, which can be moved behind the line by two or more shooters. Other offense players skate or run down rink or field to receive a passed puck (or ball in field hockey). If two offensive players receive a pass within the allotted time the farthest may be permitted to take a shot on a tended or untended goal for a score. The defense prevents the pass of the puck or ball and tends the goal, if needed. The same rules and strategies may be employed for hockey as described herein above for football.

In addition, basketballs may be employed and scoring opportunities granted if two passes have been completed. Either by permitting a field shot into a basket or permitting a lay-up etc. of a defended basket. The present invention may employ la cross equipment; soccer equipment of any other sports equipment, for example, using a flying disk. The present invention may also include customized equipment and protective gear especially designed for the sport game described herein.

In other embodiments, running plays may be employed in addition to or instead of passing plays. In one example, one play zone (e.g., zone 210) may permit a running play (e.g., a hand-off and run play) while play zone 212 permits a pass play. Rule variations may include that the pass play must be completed for the run yardage to count, or the run has to achieve a certain amount of yardage for the pass to count. The new start position can be marked in accordance with either the run or pass yardage gain. Similarly, play zones 210 and 212 may include only running zones and may be played in the same way as described above. A run may be stopped by tag, flag, tackle or any other means.

Figure 5:
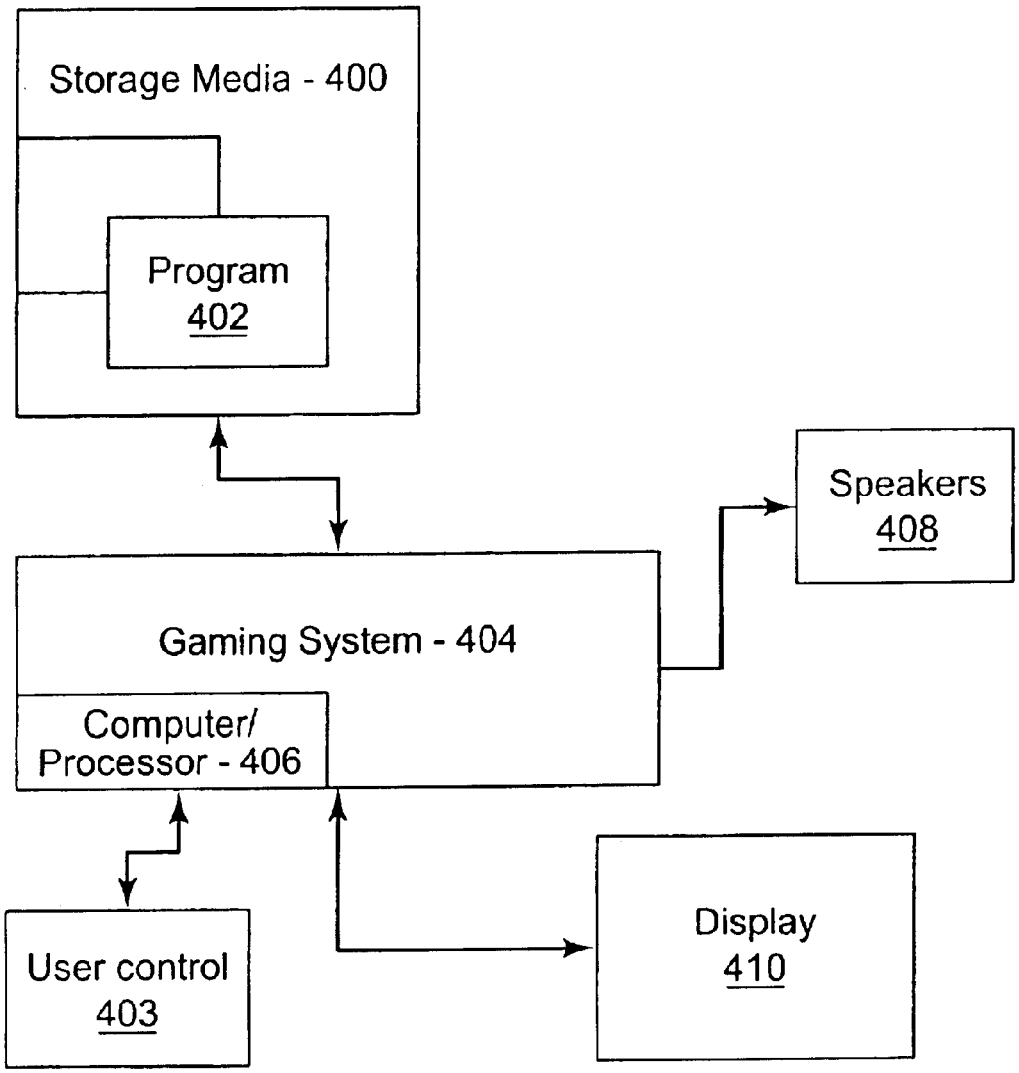
FIG. 5 is a block diagram showing a program storage device which provides for computer play in accordance with another embodiment of the present invention.

It should be understood that the elements shown in the FIG. 5 maybe implemented in various forms of hardware, software or combinations thereof. Preferably, these elements are implemented in hardware on one or more appropriately programmed general-purpose devices, which may include a processor, memory and input/output interfaces. Referring to FIG. 5, a computer storage device 400 includes a program or programs 402 which renders a field and players on a display screen which interact with a user controller 403 (controlled by one or more players) through a gaming system 404. Programs 402 permit interactive video play between one or more users with system 404 in accordance with rules and objectives as set forth in the present disclosure. Timing mechanisms (for pre-snap motion, time to pass, etc.), penalties, scoring, virtual player substitutions, virtual player statistics, other data and programs are stored, compiled and employed by system 404 to amuse users or permit competitive play between users or a computer 406. Computer may include one or more processors, interfaces and random access memory storage.

Program 402 can be programmed to provide any level of interactivity between the user and the virtual game, which is visually and audibly (through speakers 408) rendered during game play. Program 402 may be made interactive and visually and audibly rendered in accordance with known video-gaming techniques. A set of instructions provided by program 402 is preferable made to adhere to some or all of the rules and objectives as set forth herein above in the accompanying text and FIGS.

Gaming system 404 may include its own display 410, such as on a handheld video gaming system, Lap Top or personal digital assistant (PDA). Alternately, display 410 may include a television or computer monitor display, such as for computer or video game console play.

Program 402 may be included on a plurality of different media types. For example, program maybe stored in the memory of a computer, stored on a disk, compact disk, DVD, tape, cartridge or any other suitable storage device.

Figure 6:
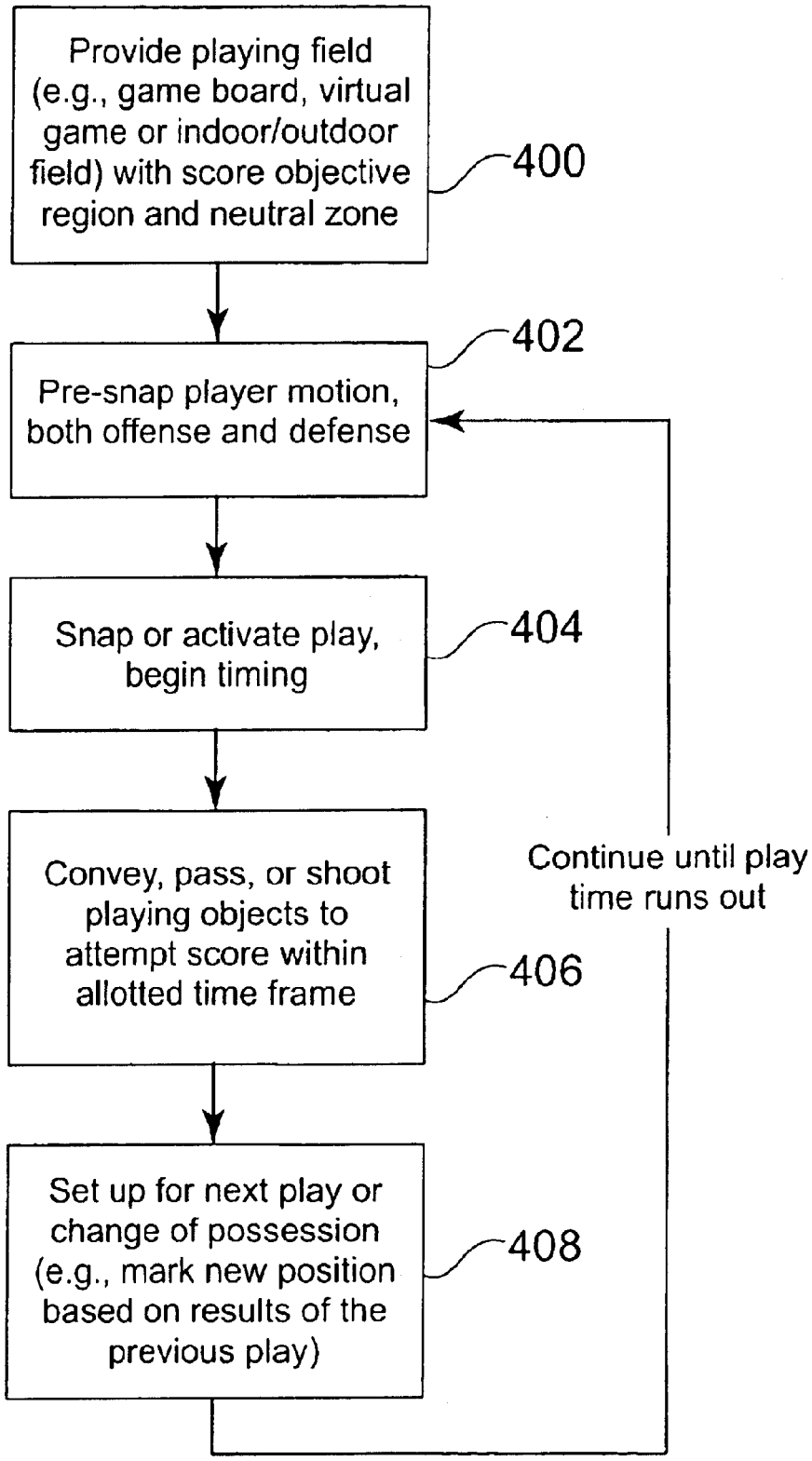
FIG. 6 is a flow diagram showing a method for playing a game in accordance with the present invention.

Referring to FIG. 6, a method of playing a game in accordance with the present invention is illustratively shown. In block 400, a playing field or play region is provided having a scoring objective region and a neutral zone extending from the scoring objective region. The neutral zone divides the playing field. In block 402, pre-snap or pre-play activation movements are permitted by the players (both offensive and defensive) until the playing objects are live activated. In block 404, at least two playing objects are activated to initiate a play wherein the activating designates play zones relative to the neutral zone where players remain for a remainder of a play. The motion between zones is ended for all or some of the players, and time is begun within which the playing objects need to be conveyed.

In block 406, the playing objects are conveyed to the players by passing, handing-off, shooting etc. to permit scoring opportunities for the players. This is to be performed within the allotted time frame to avoid penalty. In block 408, set up for a next play is performed. This may include marking a new start line, getting players to the start line, changing possession, assessing penalties, etc. The time to set up the next play may be measured and penalties assessed for taking too much time. Step 402–408 are repeated until the game ends Having described preferred embodiments for a sport game (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A method of playing a game comprising the steps of:

providing a playing field having a scoring objective region and a neutral zone extending from the scoring objective region, the neutral zone dividing the playing field;

activating at least two playing objects to initiate a play wherein the activating designates play zones relative to the neutral zone where players remain for a remainder of a play;

conveying the playing objects to the players on the field to permit scoring opportunities for the players;

performing a single play of the game that extends to all of the play zones and that involves simultaneous movement of the at least two playing objects on separate ones of the play zones; and causing a result in any given one of the play zones to impact a different result in another one of the play zones for a same play, wherein the step of conveying includes marking a start position for offensive players when two passes of the playing object are simultaneously completed in a same play.

2. The method as recited in claim 1, wherein the playing field includes one of an indoor field and an outdoor field.

3. The method as recited in claim 1, wherein the step of providing a playing field includes providing a generally rectangular playing field having an end zone, which defines the scoring objective zone.

4. The method as recited in claim 3, wherein the scoring objective zone is perpendicular to the neutral zone.

5. The method as recited in claim 1, wherein the playing objects include balls and the step of activating at least two playing objects includes snapping the balls to a passer.

6. The method as recited in claim 1, wherein the play zones are disposed on opposite sides of the neutral zone and the step of conveying the playing objects to the players on the field includes conveying the playing objects only in a pre-designated play zone outside of the neutral zone.

7. The method as recited in claim 1, wherein the step of conveying the playing objects to the players on the field to permit scoring opportunities for the players, includes passing the playing objects toward the objective scoring region to permit player to catch the playing objects to move play toward the objective scoring region.

8. The method as recited in claim 7, wherein the step of passing the playing objects toward the objective scoring region to permit player to catch the playing objects to move play toward the objective scoring region includes marking a new start point from a position of a farthest pass.

9. The method as recited in claim 1, wherein the step of conveying includes conveying the at least two playing objects within an allotted time frame.

10. The method as recited in claim 1, further comprising the step of limiting a number of consecutive scoring attempts by offensive players.

11. The method as recited in claim 10, further comprising the step of providing additional scoring attempts for offensive players if the offensive players achieve a predetermined result on a previous play.

12. The method as recited in claim 1, wherein the scoring opportunities for the players are provided to offensive and defensive players.

13. The method as recited in claim 1, wherein the step of conveying includes marking a start position for offensive players when two passes of the playing object are simultaneously completed in a same play.

14. The method as recited in claim 1, wherein the playing objects include at least one of a ball and a puck.

15. The method as recited in claim 1, further comprising the step of utilizing a furthest play ending position of a corresponding one of the at least two playing objects in the given one of the play zones as a next activation position for all of the at least two playing objects for a next play that extends to all of the play zones.

16. The method as recited in claim 15, wherein the furthest play ending position corresponds to a furthest position of two catches with respect to a previous activation position.

17. The method as recited in claim 1, wherein the result in the given one the play zones is used to replace the different result of the other one of the play zones.

18. The method as recited in claim 1, wherein the neutral zone has a pre-specified width, and any of the players present in the neutral zone during an activation of the at least two playing objects in a given play are restricted from participating in the given play.

19. The method as recited in claim 1, further comprising the step of permitting at least one of the at least two playing objects to cross the neutral zone for a completion during a given play.

20. The method as recited in claim 19, further comprising the step of restricting other ones of the at least two playing objects from crossing the neutral zone during the given play.

21. A method of playing a game, comprising the steps of:

providing a playing field having a scoring objective region and a neutral zone extending from the scoring objective region, the neutral zone being perpendicular to the scoring objective region, and the neutral zone dividing the playing field to form two or more play zones each having a portion adjacent to the scoring objective region;

permitting offensive players and defensive players to change pre-play positions across the neutral zone;

activating at least two playing objects to initiate a play wherein the activating designates the play zones on opposite sides of the neutral zone where players remain for a remainder of a play;

during a window of time, conveying the playing objects to the players on the field to permit scoring opportunities for the players;

performing a single play of the game that extends to all of the play zones and that involves simultaneous movement of the at least two playing objects on separate ones of the play zones; and causing a result in any given one of the play zones to impact a different result in another one of the play zones for a same play, wherein the result in the given one the play zones is used to replace the different result of the other one of the play zones.

22. The method as recited in claim 21, wherein the players include offensive players and defensive players for a given play, and wherein at least one of the defensive players is afforded an opportunity to score without any of the defensive players having possession of a corresponding one of the at least two playing objects.

23. The method as recited in claim 21, wherein the neutral zone has a pre-specified width, and any of the players present in the neutral zone during an activation of the at least two playing objects in a given play are restricted from participating in the given play.

24. The method as recited in claim 21, further comprising the step of permitting at least one of the at least two playing objects to cross the neutral zone for a completion during a given play.

25. The method as recited in claim 24, further comprising the step of restricting other ones of the at least two playing objects from crossing the neutral zone during the given play.

26. The method as recited in claim 21, further comprising the step of utilizing a play ending position of a corresponding one of the at least two playing objects in the given one of the play zones as a starting position of a next play that extends to all of the play zones.

27. The method as recited in claim 21, further comprising the step of utilizing a furthest play ending position of a corresponding one of the at least two playing objects in the given one of the play zones as a next activation position for all of the at least two playing objects for a next play that extends to all of the play zones.

28. The method as recited in claim 27, wherein the furthest play ending position corresponds to a furthest position of two catches with respect to a previous activation position.

29. The method as recited in claim 21, wherein the playing field includes one of an indoor field and an outdoor field.

30. The method as recited in claim 21, wherein the playing objects include balls and the step of activating at least two playing objects includes snapping the balls to a passer.

31. The method as recited in claim 21, wherein the play zones are disposed on opposite sides of the neutral zone and the step of conveying the playing objects to the players on the field includes conveying the playing objects only in a pre-designated play zones outside of the neutral zone.

32. The method as recited in claim 21, wherein the step of conveying the playing objects to the players on the field to permit scoring opportunities for the players, includes passing the playing objects toward the objective scoring region to permit player to catch the playing objects to move play toward the objective scoring region.

33. The method as recited in claim 32, wherein the step of passing the playing objects toward the objective scoring region to permit player to catch the playing objects to move play toward the objective scoring region includes marking a new start point from a position of a farthest pass.

34. The method as recited in claim 21, wherein the step of conveying includes conveying the at least two playing objects within an allotted time frame.

35. The method as recited in claim 21, further comprising the step of limiting a number of consecutive scoring attempts by offensive players.

36. The method as recited in claim 35, further comprising the step of providing additional scoring attempts for offensive players if the offensive players achieve a predetermined result on a previous play.

37. The method as recited in claim 21, wherein the scoring opportunities for the players are provided to offensive and defensive players.

38. The method as recited in claim 21, wherein the playing objects include at least one of a ball and a puck.

39. A method of playing a game comprising the steps of:

providing a playing field having a scoring objective region and a neutral zone extending from the scoring objective region, the neutral zone dividing the playing field;

activating at least two playing objects to initiate a play wherein the activating designates play zones relative to the neutral zone where players remain for a remainder of a play;

conveying the playing objects to the players on the field to permit scoring opportunities for the players;

performing a single play of the game that extends to all of the play zones and that involves simultaneous movement of the at least two playing objects on separate ones of the play zones;

causing a result in any given one of the play zones to impact a different result in another one of the play zones for a same play; and utilizing a play ending position of a corresponding one of the at least two playing objects in the given one of the play zones as a starting position of a next play that extends to all of the play zones.

40. A method of playing a game comprising the steps of:

providing a playing field having a scoring objective region and a neutral zone extending from the scoring objective region, the neutral zone dividing the playing field;

activating at least two playing objects to initiate a play wherein the activating designates play zones relative to the neutral zone where players remain for a remainder of a play;

conveying the playing objects to the players on the field to permit scoring opportunities for the players;

performing a single play of the game that extends to all of the play zones and that involves simultaneous movement of the at least two playing objects on separate ones of the play zones; and causing a result in any given one of the play zones to impact a different result in another one of the play zones for a same play, wherein the players include offensive players and defensive players for a given play, and wherein at least one of the defensive players is afforded an opportunity to score without any of the defensive players having possession of a corresponding one of the at least two playing objects.

* * * * *